US010569579B2

(12) United States Patent
Suzuki

(10) Patent No.: US 10,569,579 B2
(45) Date of Patent: Feb. 25, 2020

(54) RECORDING-HEAD POSITION ADJUSTMENT MECHANISM AND IMAGE FORMING APPARATUS INCORPORATING SAME

(71) Applicant: Isamu Suzuki, Kanagawa (JP)

(72) Inventor: Isamu Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/039,253

(22) Filed: Jul. 18, 2018

(65) Prior Publication Data

US 2019/0061396 A1 Feb. 28, 2019

(30) Foreign Application Priority Data

Aug. 29, 2017 (JP) ..... 2017-164092

(51) Int. Cl.
*B41J 25/00* (2006.01)
*B41J 25/312* (2006.01)
(Continued)

(52) U.S. Cl.
CPC ..... *B41J 25/001* (2013.01); *B41J 2/21* (2013.01); *B41J 25/003* (2013.01); *B41J 25/312* (2013.01);
(Continued)

(58) Field of Classification Search
CPC ..... B41J 2/1433; B41J 2/161; B41J 2/1623; B41J 2202/00; B41J 2202/03; B41J 2/14201; B41J 2/045; B41J 2/04588; B41J 2/04595; B41J 2/04586; B41J 2/14274; B41J 11/0015; B41J 11/002; B41J 2/01; B41J 2/211; B41J 2/17; B41J 2/17593;
(Continued)

(56) References Cited

U.S. PATENT DOCUMENTS 5,414,450 A 5/1995 Oshino et al.
2012/0044296 A1* 2/2012 Gouch ..... B41J 2/2146 347/40
2016/0236490 A1 8/2016 Maeshima et al.

FOREIGN PATENT DOCUMENTS

JP 2007-118610 5/2007
JP 2010-228434 10/2010
(Continued)

*Primary Examiner* — Manish S Shah
(74) *Attorney, Agent, or Firm* — Duft & Bornsen, PC

(57) ABSTRACT

A recording-head position adjustment mechanism includes a beam to suspend a recording head that discharges droplets so that the recording head is drawable out in a predetermined direction; a first supporter disposed at one end of the beam in the predetermined direction and having a support shaft to support the beam; a second supporter disposed at another end of the beam in the predetermined direction with the beam interposed between the first supporter and the second supporter. The second supporter is attached with an adjuster via which the second supporter supports the beam. The adjuster includes a coarse-adjustment shaft member and a fine-adjustment shaft member that are manually rotatable independent of each other. The coarse-adjustment shaft member coarsely adjusts a rotation angle of the beam at which the beam rotates around the support shaft by manual rotation. The fine-adjustment shaft member finely adjusts the rotation angle of the beam.

10 Claims, 4 Drawing Sheets

(51) Int. Cl.
*B41J 2/21* (2006.01)
*B41J 25/34* (2006.01)

(52) U.S. Cl.
CPC ..... *B41J 25/34* (2013.01); *B41J 2025/008* (2013.01); *B41J 2202/21* (2013.01)

(58) Field of Classification Search
CPC ..... B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 25/001; B41J 25/34; B41J 25/003; B41J 25/312; B41J 2025/008; B41J 2202/21; B41M 5/0011; B41M 5/0017; B41M 5/0047; B41M 7/00; B41M 7/0072; B41M 5/52; B41M 5/5218; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52
See application file for complete search history.

(56) References Cited

FOREIGN PATENT DOCUMENTS

| | | |
|---|---|---|
| JP | 2013-063608 | 4/2013 |
| WO | WO2015/198864 A1 | 12/2015 |

* cited by examiner

RECORDING-HEAD POSITION ADJUSTMENT MECHANISM AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2017-164092, filed on Aug. 29, 2017 in the Japan Patent Office, the entire disclosure of which is hereby incorporated by reference herein.

BACKGROUND

Technical Field

In an image forming apparatus, such as an inkjet printer, a technique is widely known that adjusts the positions of recording heads (printing modules) to form a good image without positional deviation.

In such an image forming apparatus, for example, recording heads (printing modules) for a plurality of colors are arranged so as to face a sheet conveyed by a conveyor. The recording heads for of the plurality of colors discharge liquid droplets toward the conveyed sheet to form a desired color image on the sheet.

SUMMARY

In an aspect of the present disclosure, there is provided a recording-head position adjustment mechanism that includes a beam, a first supporter, and a second supporter. The beam suspends a recording head that discharges droplets so that the recording head is drawable out in a predetermined direction. The first supporter is disposed at one end of the beam in the predetermined direction and has a support shaft to support the beam so that the beam is rotatable around the support shaft, the support shaft standing in a direction that is perpendicular to the predetermined direction and in which the beam extends. The second supporter is disposed at another end of the beam in the predetermined direction with the beam interposed between the first supporter and the second supporter. The second supporter is attached with an adjuster via which the second supporter supports the beam. The adjuster includes a coarse-adjustment shaft member and a fine-adjustment shaft member that are manually rotatable independent of each other. The coarse-adjustment shaft member is configured to coarsely adjust a rotation angle of the beam at which the beam rotates around the support shaft by manual rotation. The fine-adjustment shaft member is configured to finely adjust the rotation angle of the beam at which the beam rotates around the support shaft by manual rotation.

In another aspect of the present disclosure, there is provided an image forming apparatus that includes the recording-head position adjustment mechanism.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
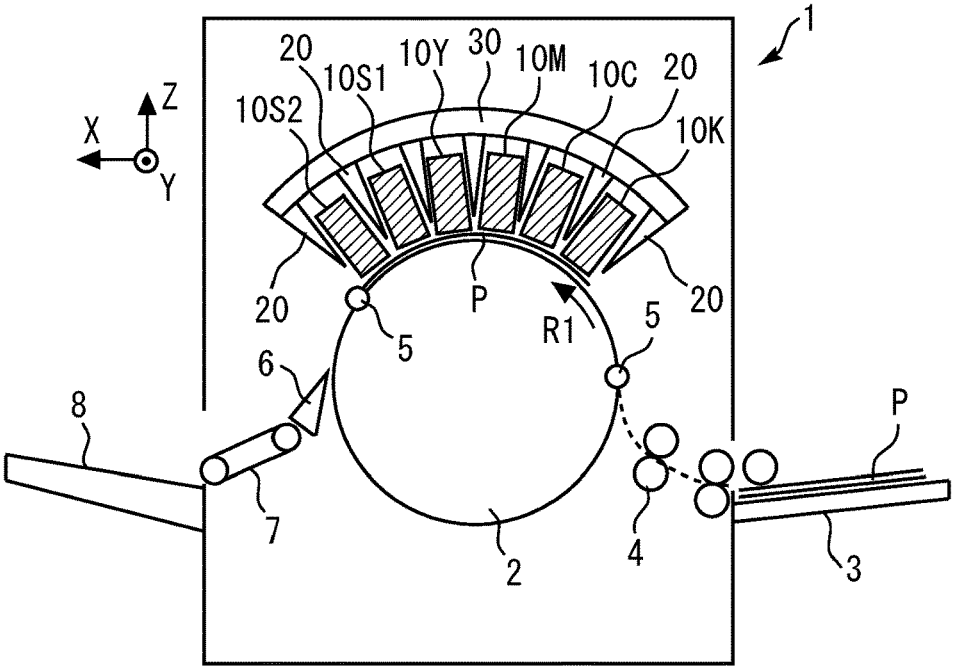
FIG. 1 is a schematic view of an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described with reference to the drawings. In the drawings, the same or corresponding parts are denoted by the same reference numerals, and redundant description thereof are simplified or omitted as appropriate.

First, with reference to FIG. 1, the overall configuration and operation of an image forming apparatus 1 according to an embodiment of the present disclosure is described below. In FIG. 1, an image forming apparatus 1 according to the present embodiment is illustrated as an inkjet printer. The image forming apparatus 1 includes a conveyance drum 2 to convey a sheet P, a sheet feed tray 3 on which sheets P to be printed are stacked, and clips 5 to hold the sheet P on the conveyance drum 2. The image forming apparatus 1 further includes a separator 6 to separate the sheet P from the conveyance drum 2, a conveyance belt 7 to convey the sheet P separated from the conveyance drum 2, and an ejection tray 8 onto which the printed sheet P is ejected and stacked. The image forming apparatus 1 further includes recording heads (printing modules) 10Y, 10M, 10C, 10K, 10S1, and 10S2 in which image forming units for printing, e.g., letters and images by an ink jet method are unitized, beams 20 to suspend the recording heads 10Y, 10M, 10C, 10K, 10S1, and 10S2, and a base frame 30 to hold the beams 20 and supporters 41 and 42.

Figure 2:
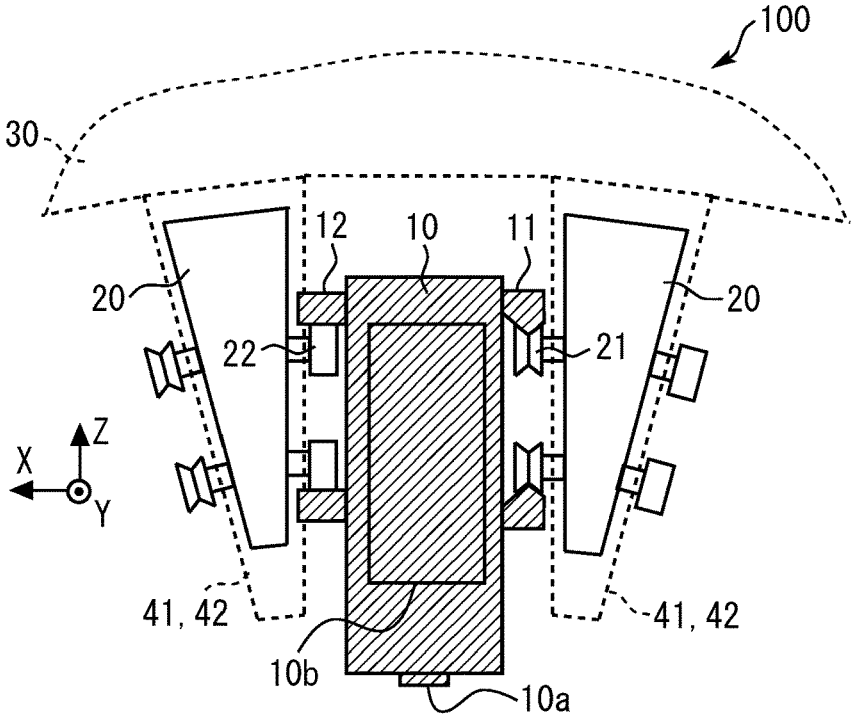
FIG. 2 is a schematic view of a state in which a recording head is suspended by a pair of beams.
Figure 4:
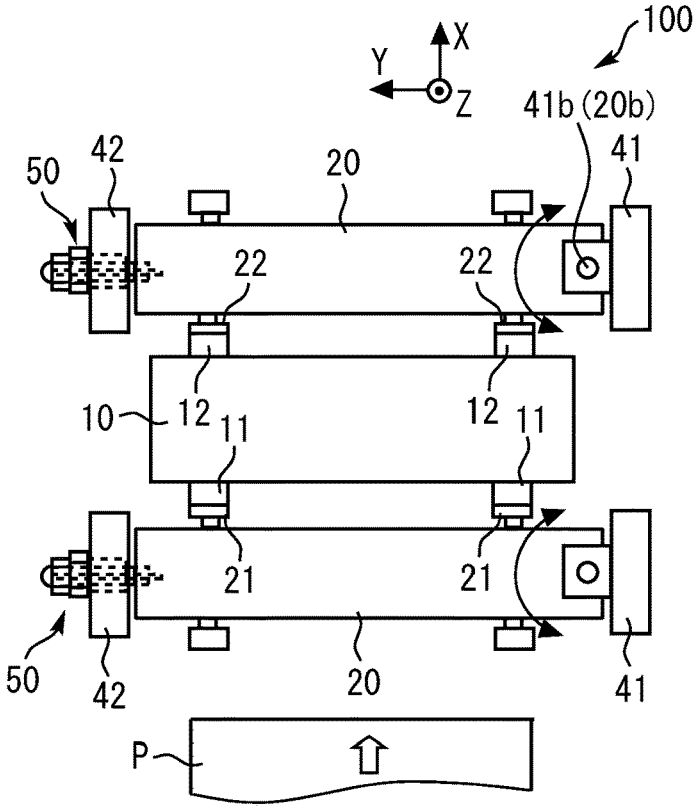
FIG. 4 is a schematic top view of a state in which the recording head is suspended by the pair of beams.

Here, as illustrated in FIG. 1, the image forming apparatus 1 according to the present embodiment forms a color image, and includes the recording head 10K for black, the recording heads 10Y, 10M, and 10C for three colors (yellow, magenta, cyan), and the recording heads 10S1 and 10S2 for coating (special color). The six recording heads 10Y, 10M, 10C, 10K, 10S1, and 10S2 are juxtaposed so as to face the conveyance drum 2 along the direction of rotation of the conveyance drum 2. Since the six recording heads 10Y, 10M, 10C, 10K, 10S1, and 10S2 have substantially the same structure except for different colors (types) of ink used for printing, the suffixes (Y, M, C, K, S1, and S2) attached to the reference numeral 10 of the recording heads may be omitted below as illustrated in FIGS. 2 and 4. As illustrated in FIG. 2, a main part of the recording head 10 includes a piezoelectric actuator, a thermal actuator, or the like, and includes, for example, nozzles 10*a* to discharge ink as droplets, an ink tank 10*b* filled with ink, and a control board (controller).

The operation of the image forming apparatus 1 is briefly described with reference to FIG. 1. First, when a print instruction is input from, e.g., a personal computer to the controller of the image forming apparatus 1 together with image data, the sheet P is fed from the sheet feed tray 3 by a sheet feed roller. The sheet P fed from the sheet feed tray 3 is conveyed toward the conveyance drum 2 by a conveyance roller 4. On the other hand, in the recording heads 10Y, 10M, 10C, 10 K, 10S1, and 10S2 of respective colors, input image data are converted into writing data of respective colors. The sheet P conveyed to the conveyance drum 2 is positioned on the conveyance drum 2 in a state of being held by the clips 5, and is conveyed along the counterclockwise rotation of the conveyance drum 2. Based on writing data, the recording heads 10Y, 10M, 10C, 10K, 10S1, and 10S2 of the respective colors sequentially discharge inks as droplets onto the sheet P, which is conveyed in a direction indicated by arrow R1 in FIG. 1 by the rotation of the conveyance drum 2, to form a desired image on the sheet P. The sheet P, on which the desired image has been formed, is separated from the conveyance drum 2 by the separator 6. The sheet P separated from the conveyance drum 2 is conveyed by the conveyance belt 7 and ejected onto the ejection tray 8.

Hereinafter, a recording-head position adjustment mechanism 100 to adjust the position of the recording head 10 for discharging ink (liquid droplets) in the image forming apparatus 1 thus configured is described below. As illustrated in, e.g., FIGS. 2 and 4, the image forming apparatus 1 includes beams 20 to suspend the recording head 10 in a state in which the recording head 10 can be drawn out in a predetermined direction (hereinafter, +Y direction) indicated by arrow Y in FIG. 4. That is, the recording head 10 is detachably (exchangeably) installed with respect to the image forming apparatus 1 so that the recording head 10 can be drawn out from the image forming apparatus 1 in the +Y direction or installed to the image forming apparatus 1 in a direction (hereinafter, −Y direction) opposite the +Y direction. When ink stored in the ink tank 10*b* becomes empty, the existing recording head 10 is drawn out, and a new recording head 10 is installed for replacement.

Specifically, the beams 20 are a pair of beams arranged to sandwich the recording head 10 in a substantially horizontal direction. As illustrated in FIG. 1, one beam 20 (excluding the beams 20 on the most upstream side and the most downstream side in a conveyance direction of the sheet P) is configured to suspend one end side of one of adjacent recording heads 10 and an opposite end side of the other of the adjacent recording heads 10. In addition, each beam 20 of the pair of beams 20 is provided with rollers 21 and 22. Specifically, as illustrated in FIG. 2, in the one beam 20, two first rollers 21 are arranged at positions apart from each other in the vertical direction on one end side of the one beam 20 and two second rollers 22 are arranged at positions apart from each other in the vertical direction at the opposite end side of the one beam 20. The first roller 21 has a V-shaped groove formed in the circumferential direction. The second roller 22 is formed in a substantially columnar shape. As illustrated in FIG. 4, the first rollers 21 are disposed at two positions apart from each other in a drawing direction (+Y direction), and the second rollers 22 The recording head 10 is provided with first rail portions 11 and second rail portions 12 to engage with the first rollers 21 and the second rollers 22 of the beam 20. Specifically, as illustrated in FIG. 2, in the recording head 10, two, upper and lower, second rail portions 12 of substantially planar shape to engage with the second rollers 22 of substantially-columnar shape are disposed on one end side of the recording head 10 in the conveyance direction of the sheet P. Two, upper and lower, first rail portions 11 (having a V-shaped protrusion) to engage with the first rollers 21 having the V-shaped grooves are disposed on the opposite end side of the recording head 10 in the conveyance direction of the sheet P. The first rail portions 11 and the second rail portions 12 are formed so as to extend in the drawing direction (+Y direction). As the first rollers 21 and the second rollers 22 relatively move while rotating on the first rail portions 11 and the second rail portions 12, the recording head 10 is pulled out in a predetermined direction (+Y direction).

With such a configuration, the recording head 10 is attached to and detached from the image forming apparatus 1 while the position of the recording head 10 in ±X directions is restricted by the first rollers 21 having the V-shaped grooves. Accordingly, attaching and detaching operations of the recording head 10 can be smoothly performed without causing failures, such as damages to the recording head 10 by interference with another member in the attachment and detachment operations. In the present embodiment, the V-shaped grooves formed in the first rollers 21 are engaged with the V-shaped protrusions formed in the first rail portions 11, to restrict the position of the recording head 10 in the ±X directions. However, the shape of the groove provided in the first roller 21 and the shape of the protrusion provided in the first rail portion 11 are not limited to the V-shape but may be any other suitable shape that can meet such a function, for example, a W-shape or a shape in which three or more V shapes are arranged.

Figure 3:
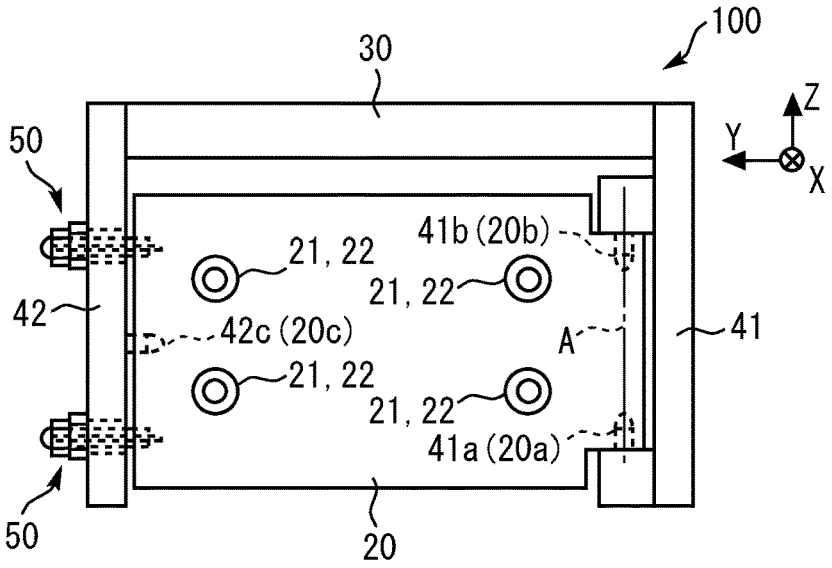
FIG. 3 is a side view of a state in which a beam is supported by two supporters.

Here, as illustrated in FIGS. 2 to 4 and so on, in the present embodiment, the beam 20 is held by a housing (the base frame 30) of the image forming apparatus 1 via two supporters (the first supporter 41 and the second supporter 42). As illustrated in FIG. 3 and so on, the first supporter 41 supports the beam 20 at one end side (the −Y direction side and the right side in FIG. 3) in the predetermined direction so that the beam 20 is rotatable around support shafts 41*a* and 41*b*. The support shafts 41*a* and 41*b* stand in directions (±Z directions) that are perpendicular to the predetermined direction and the beam 20 extends. Specifically, the first support shaft 41*a* is formed to stand up in the +Z direction below the first supporter 41. The second support shaft 41*b* stands up in the −Z direction above the first supporter 41. The beam 20 has a hole portion 20*a* fitted to the first support shaft 41*a* and a hole portion 20*b* fitted to the second support shaft 41*b*. With such a configuration, the beam 20 is supported by the first supporter 41 so as to be rotatable around a rotation axis A. The configurations of the support shaft and the hole portions are not limited to the above-described configurations of the present embodiment, but may be any other suitable configurations.

Figure 5:
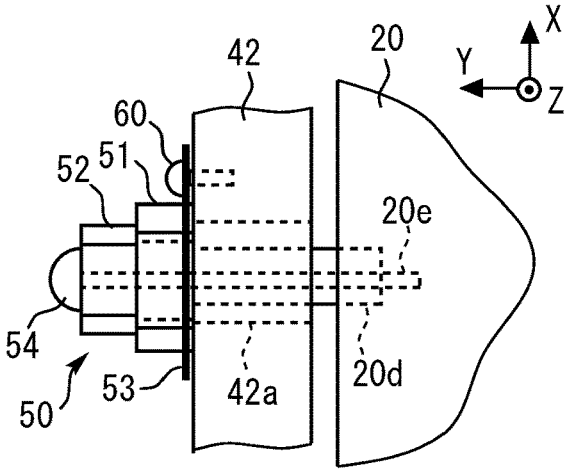
FIG. 5 is an enlarged view of a state in which an adjuster is installed in the apparatus.

The second supporter 42 is disposed so as to sandwich the beam 20 between the first supporter 41 and the second supporter 42. The second supporter 42 supports the beam 20 with adjusters 50 on the opposite end side (the +Y direction side and the left side in FIG. 3) in the predetermined direction. As illustrated in FIG. 5, the adjuster 50 includes a coarse-adjustment shaft member 51 and a fine-adjustment shaft member 52 that are manually rotatable independent of each other. The coarse-adjustment shaft member 51 is manually rotated to coarsely adjust the angle at which the beam 20 rotates around the support shafts 41*a* and 41*b*. The fine-adjustment shaft member 52 is manually rotated to finely adjust the angle at which the beam 20 rotates around the support shafts 41*a* and 41*b*. In the present embodiment, as illustrated in FIG. 3, the two adjusters 50 are disposed at positions apart from each other in the ±Z directions.

Such a configuration can efficiently, accurately, and easily adjust the position of the recording head 10 suspended on the beam 20 (the perpendicularity of the recording head 10 with respect to the conveyance direction of the sheet P). That is, in adjusting the perpendicularity of the recording head 10 with respect to the conveyance direction of the sheet P, first, the coarse-adjustment shaft member 51 is manually rotated to coarsely adjust the beam 20 so that the rotation angle of the beam 20 roughly approaches a target angle. Then, from such a state, the fine-adjustment shaft member 52 is manually rotated to perform fine adjustment so that the rotation angle of the beam 20 accurately matches the target angle. Accordingly, the adjustment work can be performed more efficiently, accurately, and easily than the case in which only the coarse adjustment is performed or the case in which only the fine adjustment is performed. The above-described accurate adjustment of the position of the recording head 10 allows an excellent image to be formed on the sheet P without positional deviation.

Figure 6:
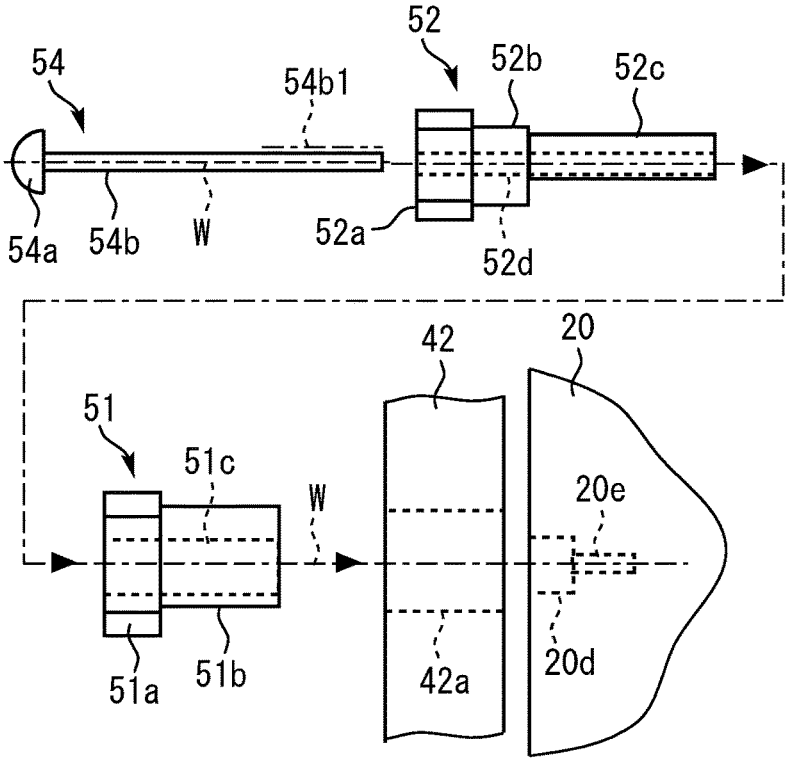
FIG. 6 is an exploded view of a state in which the adjuster is assembled to the apparatus.

As illustrated in, e.g., FIGS. 5 and 6, in the present embodiment, the coarse-adjustment shaft member 51 includes a first eccentric boss 51*b* having a large amount of eccentricity with respect to a rotation center axis W (indicated by a broken line in FIG. 6) of the adjuster 50. The fine-adjustment shaft member 52 includes a second eccentric boss 52*c* having a small eccentric amount with respect to the rotation center axis W of the adjuster 50. As a result, even if the coarse-adjustment shaft member 51 and the fine-adjustment shaft member 52 are manually rotated by the same rotation angle, the coarse-adjustment shaft member 51 can more rotate the beam 20 and the fine-adjustment shaft member 52 can less rotate the beam 20. Accordingly, the adjustment of the rotation angle of the beam 20 (the position adjustment of the recording head 10) can be efficiently, accurately, and easily performed. Specifically, in the present embodiment, the eccentric amount of the first eccentric boss 51*b* of the coarse-adjustment shaft member 51 is set to 2 mm. When the coarse-adjustment shaft member 51 is rotated by 1°, the beam 20 is moved by about 0.01 mm in the ±X directions. On the other hand, the amount of eccentricity of the second eccentric boss 52*c* of the fine-adjustment shaft member 52 is set to 0.2 mm. When the fine-adjustment shaft member 52 is rotated by 1°, the beam 20 is moved by about 0.001 mm in the ±X directions.

Figure 8:
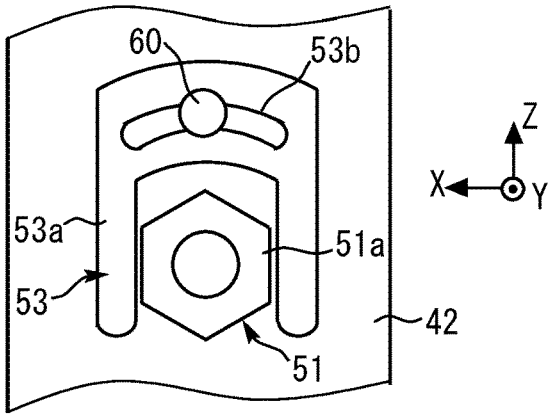
FIG. 8 is a front view of a state in which a first locking member is installed to the second supporter.
Figure 9A:
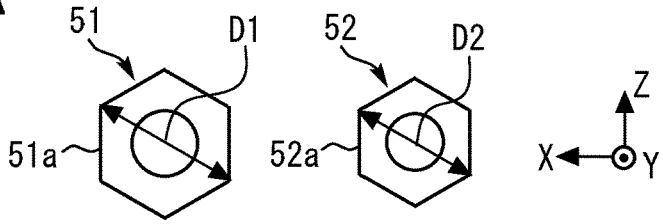
FIG. 9A is a front view of an example of a first operation portion of a coarse-adjustment shaft member and a second operation portion of a fine-adjustment shaft member.

More specifically, as illustrated in FIGS. 5 and 6, the coarse-adjustment shaft member 51 includes a first operation portion 51*a*, the first eccentric boss 51*b*, and a first through hole 51*c*. The first through hole 51*c* is formed so that the fine-adjustment shaft member 52 (a boss 52*b*) is rotatably fitted to the first through hole 51*c* and the first through hole 51*c* is not eccentric with respect to the rotational center axis W. The first eccentric boss 51*b* is eccentric with respect to the first through hole 51*c*. The first eccentric boss 51*b* fits into a fitting hole 42*a*, which is a cylindrical through hole, formed in the second supporter 42. As illustrated in FIG. 5, the first operation portion 51*a* is exposed so as to be manually operated in a state of being assembled with the apparatus. As illustrated in FIGS. 8 and 9A, the first operation portion 51*a* is formed in a hexagonal nut shape. The first operation portion 51*a* is formed with an outer diameter greater than an outer diameter of the first eccentric boss 51*b*. In the present embodiment, the first operation portion 51*a* is supposed to be manually rotated using a tool, such as a spanner.

Figure 7A:
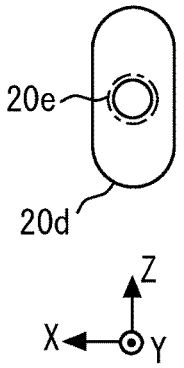
FIG. 7A is an illustration of a fitting elongated hole of a beam.

On the other hand, the fine-adjustment shaft member 52 includes a second operation portion 52*a*, the boss 52*b*, the second eccentric boss 52*c*, and a second through hole 52*d*. The boss 52*b* is rotatably fitted in the first through hole 51*c* of the coarse-adjustment shaft member 51, and is formed so as not to be eccentric with respect to the rotation center axis W. The second eccentric boss 52*c* is formed to be eccentric with respect to the boss 52*b*. The second eccentric boss 52*c* is fitted into a fitting elongated hole 20*d* (see also FIG. 7A) formed in the beam 20 so as to be rotatable and movable in the ±Z directions. Setting such a fitting hole portion, into which the second eccentric boss 52*c* fits, as the fitting elongated hole 20*d* having the ±Z directions as the longitudinal direction can disperse the force applied in the ±Z direction when the adjuster 50 is manually rotated. The second eccentric boss 52*c* is formed with an outer diameter smaller than an outer diameter of the boss 52*b*. As illustrated in FIG. 5, the second operation portion 52*a* is disposed at a position adjacent to the first operation portion 51*a* in a state of being assembled to the apparatus, and is exposed so as to be manually operated. As illustrated in FIG. 9A, the second operation portion 52*a* is formed in a hexagonal nut shape. The second operation portion 52*a* is formed with an outer diameter larger than an outer diameter of the boss 52*b*. In the present embodiment, the second operation portion 52*a* is supposed to be manually rotated using a tool, such as a spanner. The second through hole 52*d* is formed so that a shaft portion 54*b* of a second locking member 54 is inserted through the second through hole 52*d*.

Here, the recording head adjuster in the present embodiment includes a first locking member 53 and a second locking member 54. In FIGS. 5 and 8, the first locking member 53 locks the coarse-adjustment shaft member 51 so as not to rotate after the turning angle of the beam 20 is coarsely adjusted. More specifically, the first locking member 53 includes a locking portion 53*a* and an elongated hole portion 53*b*. The locking portion 53*a* is formed so as to sandwich the first operation portion 51*a* in accordance with the nut shape of the first operation portion 51*a* of the coarse-adjustment shaft member 51. The elongated hole portion 53*b* is formed so that the first locking member 53 can be rotated together with the first operation portion 51*a* in a state in which a screw 60 is loosened.

As described above, when the adjustment of the rotation angle of the beam 20 (the position adjustment of the recording head 10) is performed, first, the coarse-adjustment shaft member 51 is manually rotated to perform coarse adjustment. Even if the fine-adjustment shaft member 52 also rotates together with the coarse-adjustment shaft member 51 at that time, there is no big influence in the adjustment work. However, in a case in which fine adjustment is performed after coarse adjustment, fine adjustment could not be performed if the coarse-adjustment shaft member 51 rotates together with the fine-adjustment shaft member 52. Therefore, in the fine adjustment, the first locking member 53 restricts the coarse-adjustment shaft member 51 so as not to rotate. Specifically, during coarse adjustment, the first locking member 53 is rotated together with the first operation portion 51*a* in a state in which the screw 60 is loosened. After the coarse adjustment ends, the screw 60 is tightly screwed to a female screw portion of the second supporter 42. Thus, the first locking member 53 is fixed, thus restricting rotation of the coarse-adjustment shaft member 51.

As illustrated in FIGS. 5 and 6, the second locking member 54 locks the fine-adjustment shaft member 52 so as not to rotate after the rotation angle of the beam 20 is finely adjusted in a state in which the coarse-adjustment shaft member 51 is locked with the first locking member 53. Specifically, the second locking member 54 has a head portion 54*a* and a shaft portion 54*b* including a male screw portion 54*b*1. Until the fine adjustment with the fine-adjustment shaft member 52 ends, the male screw portion 54*b*1 of the second locking member 54 is loosely screwed against a female screw portion 20*e* (see FIG. 7A) of the beam 20. To prevent the fine-adjustment shaft member 52 (and the coarse-adjustment shaft member 51) from freely rotating after the fine adjustment with the fine-adjustment shaft member 52 ends, the male screw portion 54*b*1 of the second locking member 54 is firmly screwed to the female screw portion 20*e* of the beam 20. Thus, the first operation portion 51*a* and the second operation portion 52*a* are sandwiched between the head portion 54*a* of the second locking member 54 and the second supporter 42.

Here, in the present embodiment, as illustrated in FIG. 9A (and FIG. 5), the first operation portion 51*a* and the second operation portion 52*a* have nut-shaped outer peripheral surfaces of different outer diameters from each other. Specifically, the outer diameter D1 of the first operation portion 51*a* is greater than the outer diameter D2 of the second operation portion 52*a* (D1>D2). Such a configuration facilitates visual distinction between the first operation portion 51*a* and the second operation portion 52*a* and reduces a failure that the coarse adjustment and the fine adjustment are mistaken for each other.

Figure 9B:
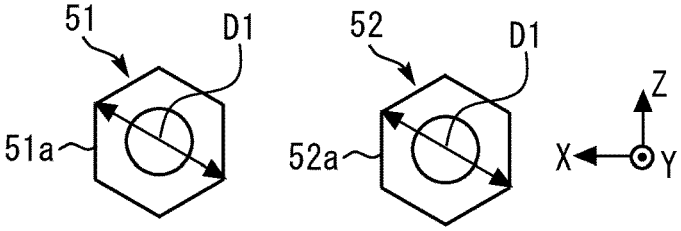
FIG. 9B is a front view of another example of the first operation portion of the coarse-adjustment shaft member and the second operation portion of the fine-adjustment shaft member.

In the present embodiment, as illustrated in FIG. 9B, the first operation portion 51*a* and the second operation portion 52*a* may have nut-shaped outer peripheral surfaces having the same outer diameter D1. In such a case, the first operation portion 51*a* and the second operation portion 52*a* can be manually rotated using the same tool (spanner), thus enhancing the efficiency of the adjustment operation.

Further, in the present embodiment, the recording head 10 is opposed to the sheet P conveyed in the +X direction, which is the direction perpendicular to the predetermined direction in which the recording head 10 is drawn out. The recording head 10 is configured to be drawn from the side of the first supporter 41 to the side of the second supporter 42. Accordingly, the position adjustment of the beam 20 (the recording head 10) can be performed on the front side in the operation direction in which the recording head 10 is attached or detached. Therefore, the workability of the position adjustment with the adjuster 50 is enhanced as compared with the case in which the position adjustment is performed on the back side in the operation direction.

Figure 7B:
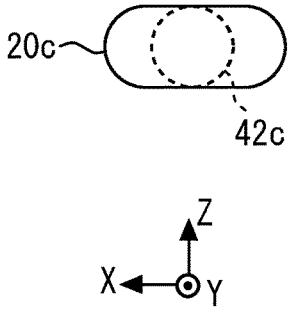
FIG. 7B is an illustration of an elongated hole in a beam.

Here, as illustrated in FIGS. 3 and 7B, in the present embodiment, the beam 20 has an elongated hole 20*c* extended in a longitudinal direction along a direction (±X directions) in which the beam 20 rotates around the support shafts 41*a* and 41*b*. The elongated hole 20*c* is disposed at a position between the two adjusters 50 in the Z direction. The second supporter 42 has a pin 42*c* standing upright in the −Y direction, to fit in the elongated hole 20*c*. With such a configuration, even when the position of the beam 20 is adjusted by the adjusters 50, the beam 20 is supported by the second supporter 42 via the pin 42*c*. That is, the pin 42*c* functions as a member to receive the weight of the beam 20. Such a configuration can reduce a failure that the second supporter 42 is deformed or the adjustment work is hampered by the weight of the beam 20 in the adjustment of the beam 20. Further, the longitudinal direction of the elongated hole 20*c*, into which the pin 42*c* fits, is along the ±X directions. Such a configuration prevents the fitting of the pin 42*c* into the elongated hole 20*c* from hampering the rotation of the beam 20 caused by the operation of the adjuster 50. In the present embodiment, the pin 42*c* is disposed directly on the second supporter 42. In some embodiments, another component having the pin 42*c* may be fixed on the second supporter 42 by, e.g., screw fastening.

As described above, in the recording-head position adjustment mechanism 100 (of the image forming apparatus 1) according to the present embodiment, the beam 20 that suspends the recording head 10 in a drawable manner includes the first supporter 41 at one end side and the second supporter 42 at the other end side. The first supporter 41 supports the beam 20 so that the beam 20 is rotatable around the support shafts 41*a* and 41*b*. The second supporter 42 supports the beam 20 via the adjusters 50. The adjuster 50 includes the coarse-adjustment shaft member 51 and the fine-adjustment shaft member 52 that can be manually rotated independent of each other. The coarse-adjustment shaft member 51 is configured to coarsely adjust the angle at which the beam 20 rotates around the support shafts 41*a* and 41*b* by manual rotation. The fine-adjustment shaft member 52 is configured to finely adjust the angle at which the beam 20 rotates about the support shafts 41*a* and 41*b* by manual rotation. Thus, the position of the recording head 10 can be efficiently and easily adjusted with high accuracy.

In the present embodiment, the image forming apparatus 1 includes the six recording heads 10Y, 10M, 10C, 10K, 10S1, and 10S2. Note that the number of recording heads is limited to six but may be any suitable number. Even in such cases, the same effects as the effects of the present embodiment can be obtained.

Note that embodiments of the present invention are not limited to the above-described embodiments and it is apparent that the above-described embodiments can be appropriately modified within the scope of the technical idea of the present invention in addition to what is suggested in the above-described embodiments. Further, the number, position, shape, and so on of components are not limited to those of the present embodiment, and may be the number, position, shape, and so on that are suitable for implementing the present invention.

What is claimed is:

1. A recording-head position adjustment mechanism comprising:

a beam to suspend a recording head that discharges droplets so that the recording head is drawable out in a predetermined direction;

a first supporter disposed at one end of the beam in the predetermined direction and having a support shaft to support the beam so that the beam is rotatable around the support shaft, the support shaft standing in a direction that is perpendicular to the predetermined direction and in which the beam extends;

a second supporter disposed at another end of the beam in the predetermined direction with the beam interposed between the first supporter and the second supporter, the second supporter attached with an adjuster via which the second supporter supports the beam, the adjuster including a coarse-adjustment shaft member and a fine-adjustment shaft member that are manually rotatable independent of each other, the coarse-adjustment shaft member configured to coarsely adjust a rotation angle of the beam at which the beam rotates around the support shaft by manual rotation; and the fine-adjustment shaft member configured to finely adjust the rotation angle of the beam at which the beam rotates around the support shaft by manual rotation.

2. The recording-head position adjustment mechanism according to claim 1, wherein the coarse-adjustment shaft member includes a first eccentric boss, and the fine-adjustment shaft member includes a second eccentric boss, wherein an amount of eccentricity of the first eccentric boss with respect to a rotation center axis of the adjuster is greater than an amount of eccentricity of the second eccentric boss with respect to the rotation center axis of the adjuster.

3. The recording-head position adjustment mechanism according to claim 2, wherein the coarse-adjustment shaft member includes:

a first through hole in which the fine-adjustment shaft member is rotatably fitted;

the first eccentric boss eccentric with respect to the first through hole and rotatably fitted in a fitting hole of the second supporter; and a first operation portion exposed for manual operation, wherein the fine-adjustment shaft member includes:

a boss rotatably fitted in the first through hole;

the second eccentric boss eccentric to the boss and rotatably fitted in a fitting elongated hole of the beam; and a second operation portion exposed for manual operation.

4. The recording-head position adjustment mechanism according to claim 3, wherein the first operation portion and the second operation portion have nut-shaped outer peripheral surfaces of different outer diameters from each other.

5. The recording-head position adjustment mechanism according to claim 3, wherein the first operation portion and the second operation portion have nut-shaped outer peripheral surfaces of a same outer diameter.

6. The recording-head position adjustment mechanism according to claim 1, further comprising:

a first locking member to lock the coarse-adjustment shaft member so that the coarse-adjustment shaft member does not rotate after the rotation angle of the beam is coarsely adjusted; and a second locking member to lock the fine-adjustment shaft member so that the fine-adjustment shaft member does not rotate after the rotation angle of the beam is finely adjusted in a state in which the coarse-adjustment shaft member is locked by the first locking member.

7. The recording-head position adjustment mechanism according to claim 1, wherein the beam has an elongated hole whose longitudinal direction is along a direction in which the beam rotates around the support shaft, wherein the second supporter includes a pin to fit in the elongated hole.

8. The recording-head position adjustment mechanism according to claim 1, wherein a pair of beams including the beam and another beam are arranged with the recording head interposed between the pair of beams in a substantially horizontal direction, wherein each of the pair of beams includes a roller, and the recording head has a rail portion to engage the roller, wherein the roller is configured to relatively move with respect to the recording head while rotating on the rail portion, to draw out the recording head in the predetermined direction.

9. The recording-head position adjustment mechanism according to claim 1, wherein the recording head is opposed to a sheet conveyed in a direction perpendicular to the predetermined direction and is drawn out from the one end of the beam at which the first supporter is disposed to said another end of the beam at which the second supporter is disposed.

10. An image forming apparatus comprising the recording-head position adjustment mechanism according to claim 1.

* * * * *